United States Patent [19]

Boyer

[11] 4,080,178

[45] *Mar. 21, 1978

[54] COLLOIDAL MAGNESIUM SUSPENSION IN CRITICAL LOW CONCENTRATION IN DIESEL FUEL

[76] Inventor: Winston Boyer, The Boyer Ranch, Savery, Wyo. 82332

[ * ] Notice: The portion of the term of this patent subsequent to Mar. 21, 1995, has been disclaimed.

[21] Appl. No.: 568,999

[22] Filed: Apr. 17, 1975

[51] Int. Cl.[2] ..... C10L 1/32

[52] U.S. Cl. ..... 44/51; 44/67; 252/309

[58] Field of Search ..... 44/51; 252/309; 149/87

[56] References Cited

U.S. PATENT DOCUMENTS

| | | | |
|---|---|---|---|
| 2,671,758 | 3/1954 | Vinograd et al. | 252/309 |
| 3,069,854 | 12/1962 | Toulmin, Jr. | 149/87 |

*Primary Examiner*—Daniel E. Wyman
*Assistant Examiner*—Mrs. Y. Harris-Smith

[57] ABSTRACT

A colloidal magnesium suspension is prepared by grinding 400 mesh pure magnesium (99.8+%) in dry kerosene until it reaches colloidal dimensions (from about 500 to 1 millimicron) and is thereafter added in critical low concentration of 1/10 grams as substantially pure magnesium up to about 6 grams per 10 gallons of diesel fuel whereby improved burning of the diesel fuel is observed as evidenced by improvement in mileage of up to 50% for the same motor settings as compared to the diesel fuel to which the colloidal magnesium has not been added. Optimum amounts of about 1/2 to 4 grams of colloidal magnesium in 10 gallons are preferred in order to minimize air pollution, while giving maximum benefit for fuel economy.

1 Claim, No Drawings

COLLOIDAL MAGNESIUM SUSPENSION IN CRITICAL LOW CONCENTRATION IN DIESEL FUEL

CROSS REFERENCE TO RELATED APPLICATIONS

Application of Winston Boyer entitled, "Colloidal Magnesium Suspension in Critical Low Concentration in Motor Gasoline and Method of Preparation", filed on even date herewith, Ser. No. 569,320, filed Apr. 17, 1975. (WB-1)

Application of Winston Boyer entitled, "Colloidal Magnesium Suspension in Critical Low Concentration in Aviation Turbine Fuel", filed on even date herewith, Ser. No. 568,998, filed Apr. 17, 1975. (WB-3)

BACKGROUND OF THE INVENTION

A. Field of the Invention

The invention lies in the field of suspension of non-gaseous solid materials, these materials being in colloidal size and obtained by grinding very finely divided substantially pure magnesium metal in pure substantially easily burning low volatility petroleum, and in particular kerosene and also is in the field of suspensions of this colloidal dispersion of substantially pure magnesium (500 to 1 millimicrons) in diesel fuel in critical proportions for the purpose of aiding combustion, there being no non-oxyhydrocarbons or non-hydrocarbon additives required for the addition and suspension and thereby controlling emissions, while improving fuel economy and efficiency.

B. Description of the Prior Art

1. Motor Fuel Economy and Emission Controls

The problem of fuel economy and emission controls has come to the forefront since the Arab Oil Embargo in 1973–74 and has gripped the attention of the auto manufacturer, the supplier of the add-on catalytic converter and the domestic oil industry in the United States. Smaller cars with new engines such as the Japanese Honda Civic CVCC (compound vortex combustion chamber) have shown under E.P.A. tests 39 miles per gallon in simulated urban driving (see article by Fred Gregory in the New York Times, Feb. 2, 1975, page A17 of Business Section) and have passed the emission standards.

However, the bulk of the cars on the road in the United States are older and heavier cars with less revolutionary engines and interim efforts are being directed to add-on pollution control devices, such as the platinum catalyst charged converter which cuts emissions to meet standards in the states and of the Federal Government. The results these past 10 years have been encouraging as stated by Gladwin Hill in the New York Times, Business Section, page A15, who reports as follows:

In 1966, when cars began using exhaust controls, the Los Angeles County Air Pollution Control District reported that the area's 3,770,000 cars were spewing out 10,485 tons of carbon monoxide each day, 1,805 tons of hydrocarbons (unburned gasoline) and 545 tons of oxides of nitrogen.

Today, with 4,470,000 cars in the area, the total is down to 5,040 tons of carbon monoxide, a 50 per cent decrease; 625 tons of hydrocarbons, a two-thirds decline, and 530 tons of oxides of nitrogen. Nitrogen oxide controls are relatively new and difficult to remove.

In 1966, there were 271 days of excessive oxidants (compounds formed from car fumes by sunlight, and often irritating to the eye); 89 days of excessive nitrogen oxides, which accounts for the brownish tint to smog, and 365 days of excessive carbon monoxide.

In 1973, there were 185 days of excessive oxidants, 59 days of excessive nitrogen oxide, and 116 days of excessive carbon monoxide.

For the fist 10 months of 1974, the totals were 202 days of excessive oxidants, 44 days of excessive nitrogen oxides and 71 days of excessive carbon monoxide.

2. Prior Patent Art a. Methods of Preparing Colloidal Metal Suspensions

Various methods are known for making colloidal metals, for example, Vaughn, U.S. Pat. No. 2,123,617, describes a method for making colloidal metal by reaction in liquid ammonia, and the literature makes references to electrolytic processes for the manufacture of colloidal magnesium.

These prior methods are expensive to carry out, because of the high cost for equipment and the need for highly skilled personnel, not to mention the high energy requirement for electrolytic processing. A further important disadvantage is the formation of impurities, oxides or nitrides, which occurs because of the high reactivity of magnesium.

In contrast to the above methods for preparing colloidal magnesium, the present process carries out the grinding by starting from 400 mesh pure (99.8+%) magnesium powder, which is dispersed in dry kerosene. The dispersing liquid is substantially free from water, and thus eliminates one of the most important reactions of metallic magnesium, which is that with water. Under ordinary atmospheric conditions or in pure water or saltfree water of high pH, however, the reaction is self-stopping, because of the formation of an insoluble hydrozide film:

$$Mg + 2\,H_2O \rightarrow Mg(OH)_2 + H_2$$

b. Finely Divided Magnesium in Fuels

The patent to Toulmin, Jr., U.S. Pat. No. 3,122,429, discloses slurry of magnesium finely divided coal and ozone in jet fuel in weight ratio of 25/75 solid fuel to liquid fuel.

The patent to Toulmin, Jr., U.S. Pat. No. 3,147,091, discloses a composite fuel of 35% by weight of powdered coal and magnesium and remainder liquid hydrocarbon.

The patent to Bradley et al, U.S. Pat. No. 2,642,345, discloses finely divided (100 $\mu$) sodium metal dispersed in diesel fuel.

OBJECTS OF THE INVENTION

In contrast to the teaching of the Toulmin, Jr. in U.S. Pat. Nos. 3,122,429 and 3,147,091, at column 1, first paragraph of these patents, the present invention employs colloidal magnesium in critically low proportions lying below any increase in calorific value of the fuel, and a basic objective of the invention is to provide pure, oxide-free magnesium in colloidal suspension in dry kerosene, for the purpose of increasing fuel economy of diesel fuel.

In further contrast to the teaching of the foregoing Toulmin, Jr. patents at column 2 of each relating to metal soap additives such as magnesium or aluminum stearate or the like to coat the metal particles, the present invention uses pure colloidal magnesium free from any soaps, which would detract from chemical activity of the free metal surface of the colloidal particles of magnesium, thereby assuring that the oxidation of colloidal magnesium occurs in the compression chamber of the engine to thereby promote complete burning of the diesel fuel, and it is an objective of the invention to use pure colloidal magnesium metal having free and uncoated metal surfaces, which do not come into any contact with polluting surface active metal salts, or other metals or oxidizing agents.

In contrast to the dispersion of the Bradley et al patent, above mentioned, which requires the use of very reactive sodium metal, such as formamide or dimethyl formamide, the present colloidal magnesium suspension, consists essentially of combustible hydrocarbons, dry kerosene, and diesel fuel as the dispersant and active free metal particles between 500 and 1 millimicron, is free from nitrogen compounds or sulfur compounds acting as pollutants, and it is a further object of the invention to provide a non-hazardous combustion promotor composition for diesel fuel.

The foregoing and other objects of the invention will be more readily understood in view of the summary of the invention and the following description of the preferred embodiments of the invention in the Examples.

SUMMARY OF THE INVENTION

Colloidal magnesium metal of high purity (99.8+%) prepared by grinding 400 mesh pure magnesium in dry kerosene is added in critical low concentrations of 1/10 to 8 grams preferably about ½ to 4 grams in each 10 gallons of diesel fuel and provides improved burning as evidenced by increased mileage of about 50% as compared to the same diesel fuel to which the colloidal magnesium has not been added.

DESCRIPTION OF THE PREFERRED EMBODIMENTS

EXAMPLE 1

Preparation of Colloidal Pure Magnesium in Dry Kerosene by Grinding

Commercially pure 400 mesh magnesium metal (99.8+% and about 0.003% each of aluminum and copper, 0.03% iron, 0.08% manganese, 0.001% nickel, and 0.005% silicon) supplied by Reed Manufacturing Company, Lakehurst, New Jersey, is dispersed in dry kerosene in a ratio of 25 parts by weight of magnesium (50) grams to 75 parts by weight of dry kerosene, and the entire mixture is charged into the 17¾ inch diameter mixing bowl of a Vulcan Hart Heavy Dough Mixing Machine, which grind in the mixing bowl by rotary rubbing movement of a top moving circular steel plate of ½ inch thickness and 11¼ inch diameter against a base circular plate of ¼ inch by 17¼ inch diameter. To eliminate contamination by iron particles, the base plate was replaced by a 3% Al — 1% Zn — magnesium plate ¼ inch thick 17¼ inches in diameter. The rubbing movements of the top plate are controlled by eccentrics to define an ovoid movement in different portions of the larger base plate.

After 8 hours of grinding, the suspension was filtered and determined to be colloidal (microscopic examination) between 1 and 500 millimicrons. The mixture was filtered through fine cloth and less than 1% was removed.

EXAMPLE 2

Mixing Colloidal Magnesium in Diesel Fuel and Testing

The compositions of diesel fuels are significantly different from the compositions of motor gasoline as disclosed in my copending related application (WB-1) "Colloidal Magnesium Suspension in Critical Low Concentration in Motor Gasoline and Method of Preparation".

There are three major grades of diesel fuel oil, namely, grade no. 1-D, grade no. 2-D, and grade no. 4-D.

Grade no. 1-D uses a refinery stream of straight-run fractions including kerosene to intermediate distillations from paraffinic crude or treated fractions from mixed-base crudes. This grade is used in mobile service such as trucks, railroad and submarines, high-speed engines with wide variations in loads and speeds, and low-temperature service.

Grade no. 2-D uses a refinery stream similar to grade no. 1-D but with lower volatility. This grade is used for industrial and heavy mobile service, high-speed engines with high loads and uniform speeds.

Grade no. 4-D is based upon a refinery stream which comprises residual fuel oils blended with more viscous distillates. This grade is used in large stationary installations, and engines with sustained loads and constant speeds.

Table 1, below, gives the specifications of diesel fuel oils: The colloidal magnesium suspension of Example 1 is added to the diesel fuel oil in critical concentration based upon the magnesium metal content per 10 gallons of diesel oil, and the optimum dosage is based upon the grade. In grade 1-D, the most volatile and lightest grade, the optimum amount is from about ½ to about 2½ grams colloidal magnesium per 10 gallons of light diesel. In grade 2-D the optimum amount is from about 1½ to 3 grams of colloidal magnesium per 10 gallons of medium diesel. In grade 4-D the optimum amount is from about 2 to 4 grams colloidal magnesium in 10 gallons of heavy diesel oil.

The illustrative truck testing of the present example is for a 1100 mile trip of Mar. 14, 1975 made in partly mountainous country on a 20 ton rig, 10 ton tractor and 10 ton trailer and 10 ton loaded trailer to give 20 ton combined weight, in which the fuel was a light 1-D Diesel fuel (see Table 1 below) containing an amount close to the upper optimum limit, e.g., 2½ grams of magnesium per 10 gallons of light diesel oil. The trip started at Kirkland Junction, Arizona and ended at Boise, Idaho. The average mileage without the additive on the same trip taken earlier was 4 to 5 miles per gallon. The engine of the trailer was a 220 HP Cummings Diesel, 5 years old, equipped with Blower attachment without any change in engine setting, the average mileage on the trip was between 9 and 10 miles per gallon.

Table 1

Specifications of Diesel Fuel Oils (ASTM D 975) (6)

| Properties | Grade | | |
|---|---|---|---|
| | No. 1-D | No. 2-D | No. 3-D |
| distillation, 90% pt,° F | 550 max | 540–640 | |
| flash pt, max, ° F | 100 | 125 | 130 |
| pour pt, max, ° F | 10° below ambient temp | | |
| water and sediment, max, vol % | trace | 0.10 | 0.50 |

Table 1-continued

Specifications of Diesel Fuel Oils (ASTM D 975) (6)

| | Grade | | |
|---|---|---|---|
| carbon in 10% residuum, max, % | 0.15 | 0.35 | |
| ash, max, wt % | 0.01 | 0.02 | 0.10 |
| viscosity, kinematic, cS at 100° F | 1.4–2.5 | 2.0–4.3 | 5.8–26.4 |
| sulfur, max, wt % | 0.50 | 1.0 | 2.0 |
| octane number, min | 40 | 40 | 30 |

What is claimed is:

1. Composition consisting essentially of diesel fuel and pure colloidal magnesium metal soap-free to be used in a diesel engine:

said colloidal magnesium being in a small volume of kerosene, the particle size of said magnesium being from about 1 to about 500 millimicrons; and, said diesel fuel in which the magnesium is suspended together with said kerosene providing magnesium of said suspension in relation to said diesel fuel at a critical concentration of from at least 1/10 gram magnesium per 10 gallons of diesel fuel up to about 6 grams magnesium per 10 gallons of diesel fuel.

* * * * *